US010532865B2

(12) United States Patent
Koeppel et al.

(10) Patent No.: US 10,532,865 B2
(45) Date of Patent: Jan. 14, 2020

(54) PRESENTATION BOX FOR A TRANSACTION CARD

(71) Applicant: Capital One Services, LLC, McLean, VA (US)

(72) Inventors: Adam Koeppel, Washington, DC (US); Molly Johnson, Alexandria, VA (US); Natasha Jensen, San Francisco, CA (US); Daniel Clifton, San Francisco, CA (US)

(73) Assignee: Capital One Services, LLC, McLean, VA (US)

( * ) Notice: Subject to any disclaimer, the term of this patent is extended or adjusted under 35 U.S.C. 154(b) by 0 days.

(21) Appl. No.: 16/514,408

(22) Filed: Jul. 17, 2019

(65) Prior Publication Data

US 2019/0337693 A1 Nov. 7, 2019

Related U.S. Application Data

(63) Continuation of application No. 15/988,706, filed on May 24, 2018, now Pat. No. 10,364,075, which is a (Continued)

(51) Int. Cl.
*B65D 51/24* (2006.01)
*B65D 77/24* (2006.01)
(Continued)

(52) U.S. Cl.
CPC ..... *B65D 51/249* (2013.01); *A45C 11/00* (2013.01); *A45C 11/18* (2013.01); *A45C 11/182* (2013.01); *B65D 43/16* (2013.01); *B65D 77/24* (2013.01)

(58) Field of Classification Search
CPC ..... B65D 51/249; B65D 43/16; B65D 77/24; B65D 5/52; B65D 5/524; B65D 5/5213; (Continued)

(56) References Cited

U.S. PATENT DOCUMENTS 47,430 A 4/1865 Kolb
371,182 A 10/1887 Evans et al.
(Continued)

FOREIGN PATENT DOCUMENTS

KR 101659308 B1 9/2016

OTHER PUBLICATIONS

AVTProjects., "J.P. Morgan Chase Palladium Credit Card Unboxing Review (Palladium and White Gold not Centurion)," Mar. 29, 2012, 3 pages. Retrieved from Internet:[URL:https://www.youtube.com/watch?v=duasEVnoYmE].
(Continued)

*Primary Examiner* — Chun Hoi Cheung
*Assistant Examiner* — Brijesh V. Patel
(74) *Attorney, Agent, or Firm* — Harrity & Harrity, LLP

(57) ABSTRACT

A presentation box for presenting a transaction card may include a hinged lid connected to a hinge edge of the presentation box, the hinged lid to pivot about the hinge edge of the presentation box when moved between a closed position and an open position; and/or a presentation apparatus that may include a tether that may be attached to the hinged lid, and/or a sleeve to receive the transaction card, where the presentation apparatus is to move the transaction card between a first position when the hinged lid is in the closed position and a second position when the hinged lid is in the open position, where the first position is different from the second position.

20 Claims, 12 Drawing Sheets

Related U.S. Application Data continuation of application No. 15/719,098, filed on Sep. 28, 2017, now Pat. No. 9,988,193.

(51) Int. Cl.

| | |
|---|---|
| ***B65D 43/16*** | (2006.01) |
| ***A45C 11/18*** | (2006.01) |
| ***A45C 11/00*** | (2006.01) |

(58) Field of Classification Search

CPC .... B65D 5/5233; B65D 5/526; B65D 5/5206; B65D 83/005

USPC ..... 206/6.1, 320, 701, 722–723, 736, 747, 206/755–756, 761–762, 764–765, 768, 206/804, 45.2, 45.21, 45.24

See application file for complete search history.

(56) References Cited

U.S. PATENT DOCUMENTS

| | | | | |
|---|---|---|---|---|
| 1,029,096 | A | 6/1912 | Wolf et al. | |
| 1,536,765 | A | 5/1925 | Bulova et al. | |
| 1,859,049 | A | 5/1932 | Poppe et al. | |
| 2,219,597 | A | 10/1940 | Lutz et al. | |
| 2,657,793 | A | 11/1953 | Goldshine et al. | |
| 2,680,512 | A | 6/1954 | Young et al. | |
| 2,698,084 | A * | 12/1954 | Burroughs | A45C 11/10 206/755 |
| 2,991,876 | A * | 7/1961 | Shiffman | A45C 11/16 206/754 |
| 3,353,657 | A | 11/1967 | Lewis et al. | |
| 3,765,528 | A * | 10/1973 | Parisot | A45C 11/00 206/754 |
| 5,096,055 | A | 3/1992 | Opper et al. | |
| 5,452,793 | A | 9/1995 | Dimeo, Jr. et al. | |
| 5,682,999 | A | 11/1997 | Larson et al. | |
| 5,979,661 | A | 11/1999 | Sherman et al. | |
| 7,325,682 | B2 * | 2/2008 | Seymour | B25H 3/003 206/379 |
| 7,469,785 | B2 | 12/2008 | Murata et al. | |
| 7,938,270 | B2 | 5/2011 | Davis | |
| 8,474,619 | B1 | 7/2013 | Chrisman et al. | |
| 9,988,193 | B1 | 6/2018 | Koeppel et al. | |
| 10,364,075 | B2 | 7/2019 | Koeppel et al. | |
| 2005/0155905 | A1 | 7/2005 | Monk et al. | |
| 2005/0258060 | A1 | 11/2005 | Katz | |
| 2009/0326707 | A1 | 12/2009 | Mattila et al. | |
| 2012/0018346 | A1 | 1/2012 | Kirsch et al. | |
| 2013/0161214 | A1 | 6/2013 | Nebeker et al. | |
| 2013/0284202 | A1 | 10/2013 | Limongi et al. | |
| 2014/0027331 | A1 | 1/2014 | Ladayni et al. | |
| 2014/0262932 | A1 | 9/2014 | Lenkeit et al. | |
| 2015/0114880 | A1 | 4/2015 | Hough et al. | |

OTHER PUBLICATIONS

Extended European Search Report for Application No. EP18196772.0, dated Nov. 27, 2018, 9 pages.

Kheel J.M., "Unboxing the Citi Prestige Card (Video)," Aug. 11, 2017, 9 pages. Retrieved from Internet:[URL: https://thepointsguy.com/2017/08/citi-prestige-unboxing-video/].

* cited by examiner

PRESENTATION BOX FOR A TRANSACTION CARD

CROSS-REFERENCE TO RELATED APPLICATIONS UNDER 35 U.S.C. § 120

This application is a continuation of U.S. patent application Ser. No. 15/988,706, filed on May 24, 2018 (now U.S. Pat. No. 10,364,075), entitled "PRESENTATION BOX FOR A TRANSACTION CARD," which is a continuation of U.S. patent application Ser. No. 15/719,098, filed on Sep. 28, 2017 (now U.S. Pat. No. 9,988,193), entitled "PRESENTATION BOX FOR A TRANSACTION CARD," the contents of which are incorporated by reference herein in their entirety.

BACKGROUND

Cardholders (e.g., consumers) may utilize transaction cards to process transactions at transaction terminals (e.g., point of sale (PoS) terminals, automated teller machine (ATM) terminals, access terminals (e.g., locking mechanisms for gates, doors, rooms, etc.), reward redemption terminals, and/or the like). The transaction cards may be issued by entities that manage accounts, identification information, and/or an access keys associated with the cardholders.

SUMMARY

According to some implementations, a presentation box for presenting a transaction card may include a hinged lid connected to a hinge edge of the presentation box, the hinged lid to pivot about the hinge edge of the presentation box when moved between a closed position and an open position; and/or a presentation apparatus that may include a tether that may be attached to the hinged lid, and/or a sleeve to receive the transaction card, where the presentation apparatus is to move the transaction card between a first position when the hinged lid is in the closed position and a second position when the hinged lid is in the open position, where the first position is different from the second position.

According to some implementations, a presentation apparatus to present a transaction card from inside a presentation box may include a sleeve to receive the transaction card; and/or a tether attached to an opening edge of the sleeve to form a hinge, where the tether may be attached to a hinged lid of the presentation box that may pivot about a hinge edge of the presentation box when moved between an open position and a closed position, and the sleeve may move between a first position when the hinged lid is in the closed position and a second position when the hinged lid is in the open position, such that the transaction card may be presented in the sleeve in the open position in a manner that the transaction card may not be parallel to a base of the presentation box to facilitate removal of the transaction card from the sleeve, and where the first position has a different orientation than the second position.

According to some implementations, a presentation assembly for presenting a transaction card may include a presentation box including a hinged lid connected to a hinge edge of the presentation box that may pivot about the hinge edge of the presentation box when moved between a closed position and an open position and/or a support that extends from a base of the presentation box; and/or a presentation apparatus including a tether that is attached to the hinged lid, and/or a sleeve that is attached to the support to receive the transaction card, where the presentation apparatus may move the transaction card in the sleeve between a first position when the hinged lid is in the closed position and a second position when the hinged lid is in the open position, where the first position has a different orientation that the second position.

DETAILED DESCRIPTION

The following detailed description of example implementations refers to the accompanying drawings. The same reference numbers in different drawings may identify the same or similar elements.

Transaction cards may be issued and/or provided to users (e.g., cardholders, card members, account holders, and/or the like) having accounts with transaction card-issuing entities. For example, a transaction card-issuing entity may be a bank that sends a payment card (e.g., a credit card, a debit card, and/or the like) to a user that has an account (e.g., a credit account, a checking account, a savings account, and/or the like) with the bank. In providing the card, the user may receive the card via mail (e.g., in an envelope) and/or via a shipping company.

Examples herein provide a presentation box (which may be referred to herein as "the presentation box") that may present the transaction card to a user as the user opens the presentation box by moving the card from a first position (when the presentation box is closed) to a second position (when the presentation box is opened). For example, the transaction card may be in a relatively horizontal position (or parallel to a base of the presentation box) within the presentation box when the presentation box is closed and may move to a relatively vertical position (or perpendicular to a base of the presentation box) as the presentation box is opened (e.g., by the user). Accordingly, the user may experience a more enjoyable, unique and interactive presentation of the transaction card (e.g., when the transaction card is initially received and/or unboxed) relative to previous techniques of opening or unboxing a transaction card. Furthermore, in some implementations, presentation of the transaction card may facilitate removal of the transaction card from the presentation box. For example, the removal of the transaction card may be improved over previous techniques be making multiple sides of the transaction card (e.g., at least fifty percent of both the front, back, and sides of the transaction card) more accessible to the user, enabling the user to easily grab and remove the transaction card from the box.

As used herein, a transaction card may include a credit card, a debit card, an access card, an ATM card, a membership card (or client loyalty program card), a health insurance card, a gift card, a driver's license, and/or the like. Although examples herein may refer to use of the presentation box with a transaction card, various other objects of similar sizes, weight, and/or capabilities (e.g., business cards, tickets, coupons, certificates, electronic devices (e.g., mobile device, memory or storage devices, computer interface devices, etc.), and/or the like) may be presented via the presentation box and/or a presentation assembly described herein.

Figure 1:
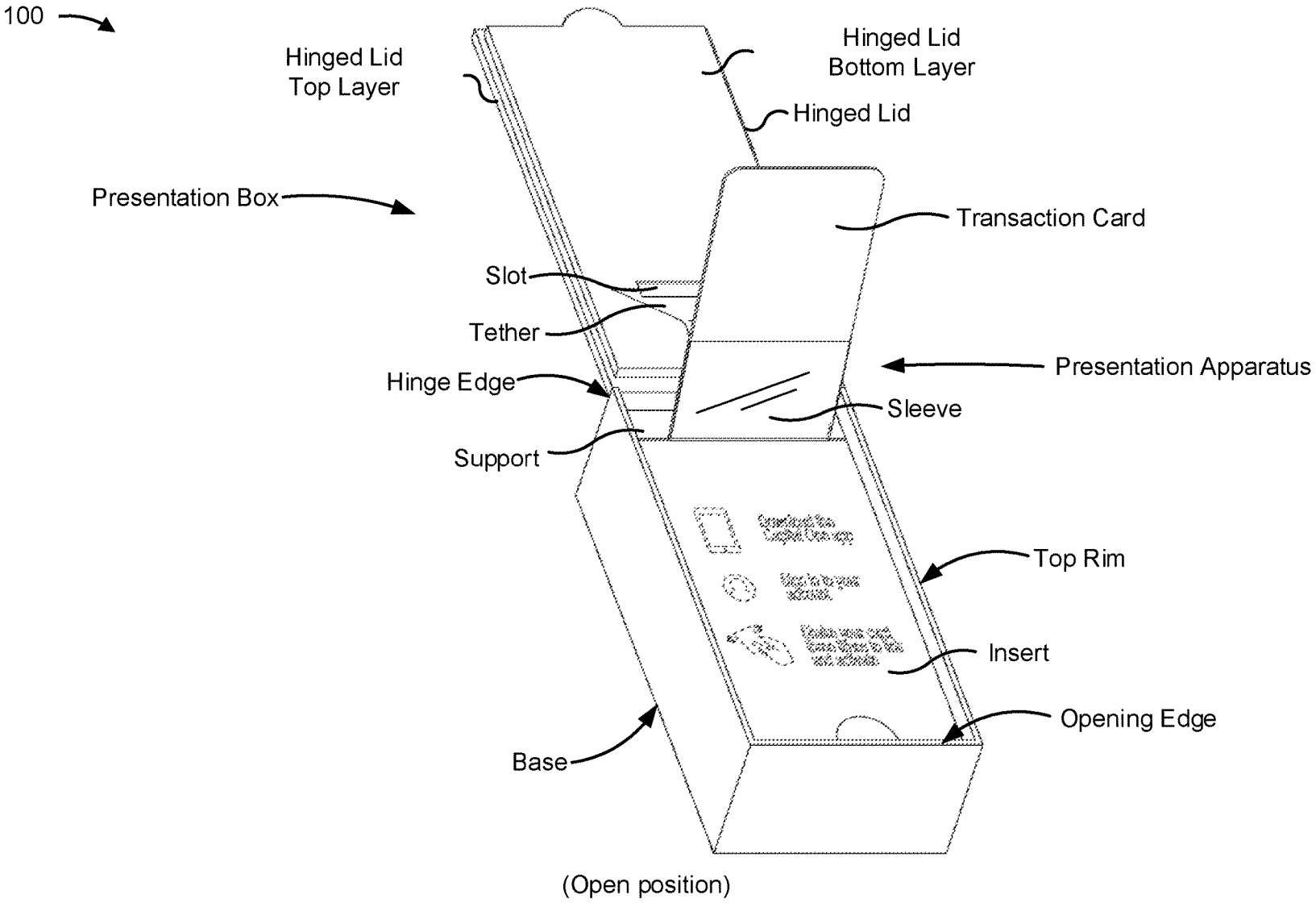
FIG. 1 is an illustration of an example implementation of a presentation assembly including a presentation box described herein.

FIG. 1 is an illustration of an example implementation of a presentation assembly including a presentation box described herein. In FIG. 1, the example implementation 100 includes a presentation box presenting a transaction card via a presentation apparatus that holds the transaction card. The presentation apparatus may present the transaction card as a hinged lid of the presentation box is moved between a closed position, a partially open position, and an open position. FIG. 1 shows the presentation box in the open position. According to some implementations, the presentation box may be transitioned between the closed position and open positions based on a user opening or closing the presentation box by moving the hinged lid, based on a mechanical apparatus (e.g., a spring, a motor, and/or the like) automatically opening or closing the presentation box by moving the hinged lid, and/or the like.

The example implementation 100 of FIG. 1 includes the presentation box and a presentation apparatus. The presentation box has the hinged lid, a base, a hinge edge, an opening edge, a top rim, and a support. The hinged lid includes a top layer, a bottom layer, and a slot in the bottom layer. As shown in FIG. 1, the hinge edge is opposite the opening edge of the presentation box such that side edges extend from the hinge edge to the opening edge. Further, the base is opposite the top rim of the presentation box, such that side surfaces of the presentation box extend from the base to the top rim.

In example implementation 100, the hinged lid is connected to or is formed as part of the hinge edge of the presentation box such that the hinged lid is capable of pivoting about the hinge edge of the presentation box as the hinged lid moves or is moved. For example, when the hinged lid moves from a first position (e.g., a closed position) to a second position (e.g., an open position), the hinged lid pivots about the hinge edge of the presentation box.

Further, as shown in FIG. 1, the presentation apparatus includes a tether and a sleeve. In FIG. 1, the transaction card is presented within the sleeve of the presentation apparatus. For example, the sleeve of the presentation apparatus may receive the transaction card (e.g., the transaction card may be inserted into the sleeve by a user, an assembly machine, and/or the like). In some implementations, the dimensions of the sleeve may correspond to the dimensions of the transaction card. Accordingly, the sleeve may be designed to receive the transaction card, such that the transaction card is secured within the sleeve.

In the example implementation, the presentation apparatus is connected to or is formed as part of the presentation box. In the example implementation 100, the tether is connected to the hinged lid of the presentation box and the sleeve, and the sleeve is connected to the support of the presentation box, which extends from the base of the presentation box toward the hinge edge. Accordingly, the presentation apparatus is mechanically connected to the hinged lid and a support extending from the base of the presentation box. Therefore, as the hinged lid moves or is moved relative to the base (i.e., as the hinged lid pivots about the hinge edge), the presentation apparatus also moves in a manner to present the transaction card based on the movement.

In some implementations, the presentation apparatus may be connected to the hinged lid by inserting the tether or a tab of the tether into the slot of the hinged lid. As shown, the slot is in the bottom layer of the hinged lid. In some implementations, a space may be formed between the top layer and the bottom layer of the hinged lid (e.g., based on an overall thickness of the hinged lid, a thickness of the bottom layer, and a thickness of the top layer).

In some implementations, the presentation apparatus may be connected to the support of the presentation box by a sleeve tab at the base of the sleeve. In this case, the sleeve tab may be adhered to or fit into the support. For example, the support may include a structure that extends from the base of the presentation box that is capable of receiving the sleeve tab. As such, the support may include a slot (e.g., similar to the slot of the hinged lid) that receives the sleeve tab and secures the presentation apparatus to the support and/or the base of the presentation box.

Furthermore, as shown in FIG. 1, the presentation box may include an insert at the base of the sleeve where the sleeve is connected to the base of the presentation box. In some implementations, the insert may be below or above a base of the sleeve. In some implementations, the insert may rest upon or be supported by the support. For example, the support may include a structure that is molded to fit the insert. The insert of the example implementation 100 may be removed to reveal or make accessible a compartment formed within or that includes a structure of the presentation box and/or the support of the presentation box. The compartment may include a volume of the presentation box capable of storing or holding one or more items associated with the transaction card, such as one or more interface devices, one or more charging devices, documentation, and/or the like.

In some implementations, the presentation box may have specific dimensions (within a tolerance range) for holding and/or presenting a transaction card. For example, the presentation box may have a height of approximately 45 millimeters, a length of approximately 120 millimeters, and/or a width of approximately 70 millimeters. In some implementations, the presentation apparatus may have specific dimensions. For example, the length of the tether and/or the depth of the sleeve may be 35 millimeters and the width of the tether and/or sleeve may be 55 millimeters.

Accordingly, the example implementation 100 of FIG. 1 provides a presentation assembly for presenting a transaction card via a presentation box. The presentation assembly enables the transaction card to be presented as a hinged lid of the presentation box is opened by moving the transaction card from a first position (in a closed position) to a second position (in an open position).

As indicated above, FIG. 1 is provided merely as an example. Other examples are possible and may differ from what was described with regard to FIG. 1.

Figure 2A:
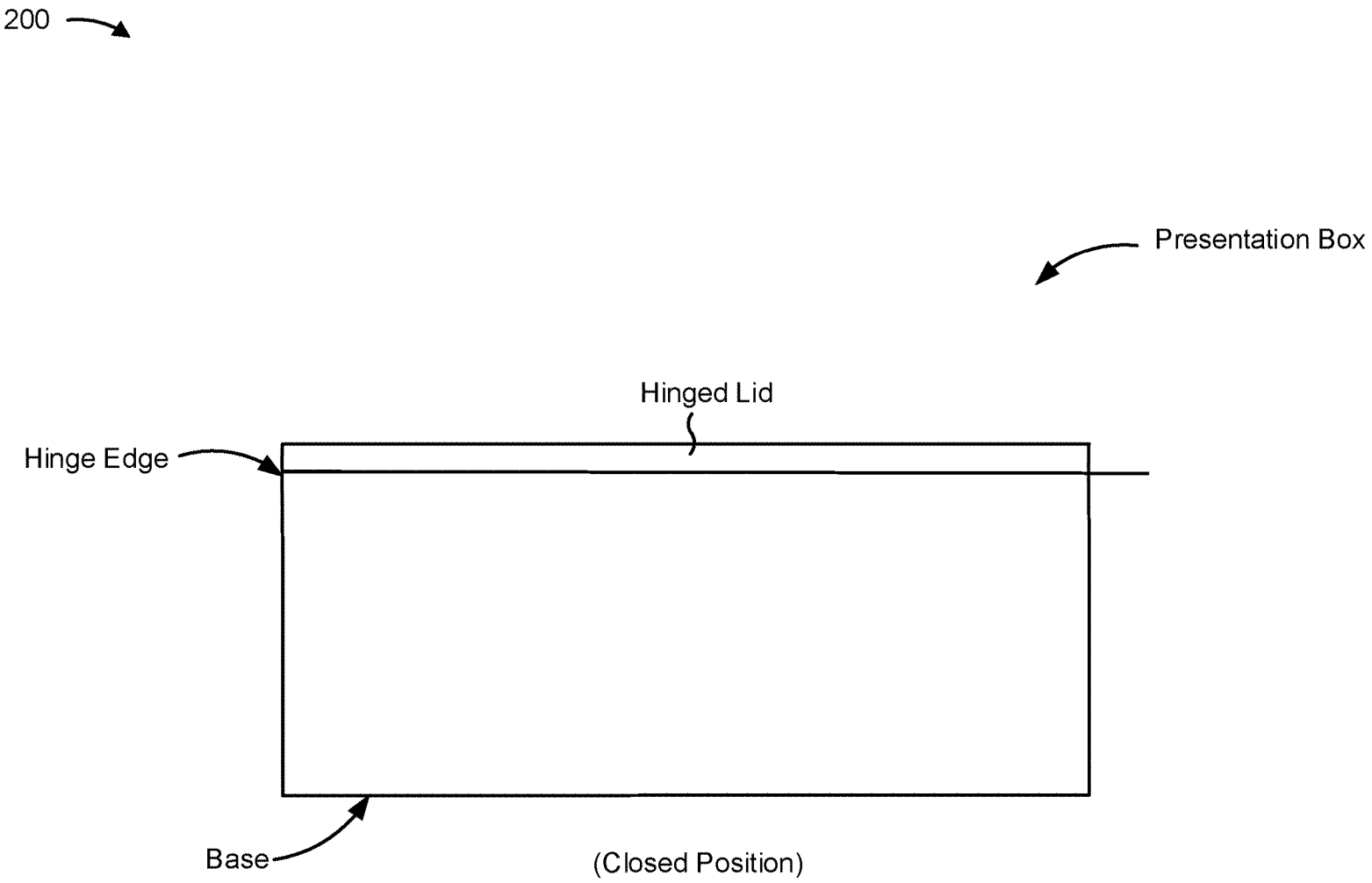
FIGS. 2A-2C are diagrams of an example implementation of a use of the presentation assembly of FIG. 1.
Figure 2B:
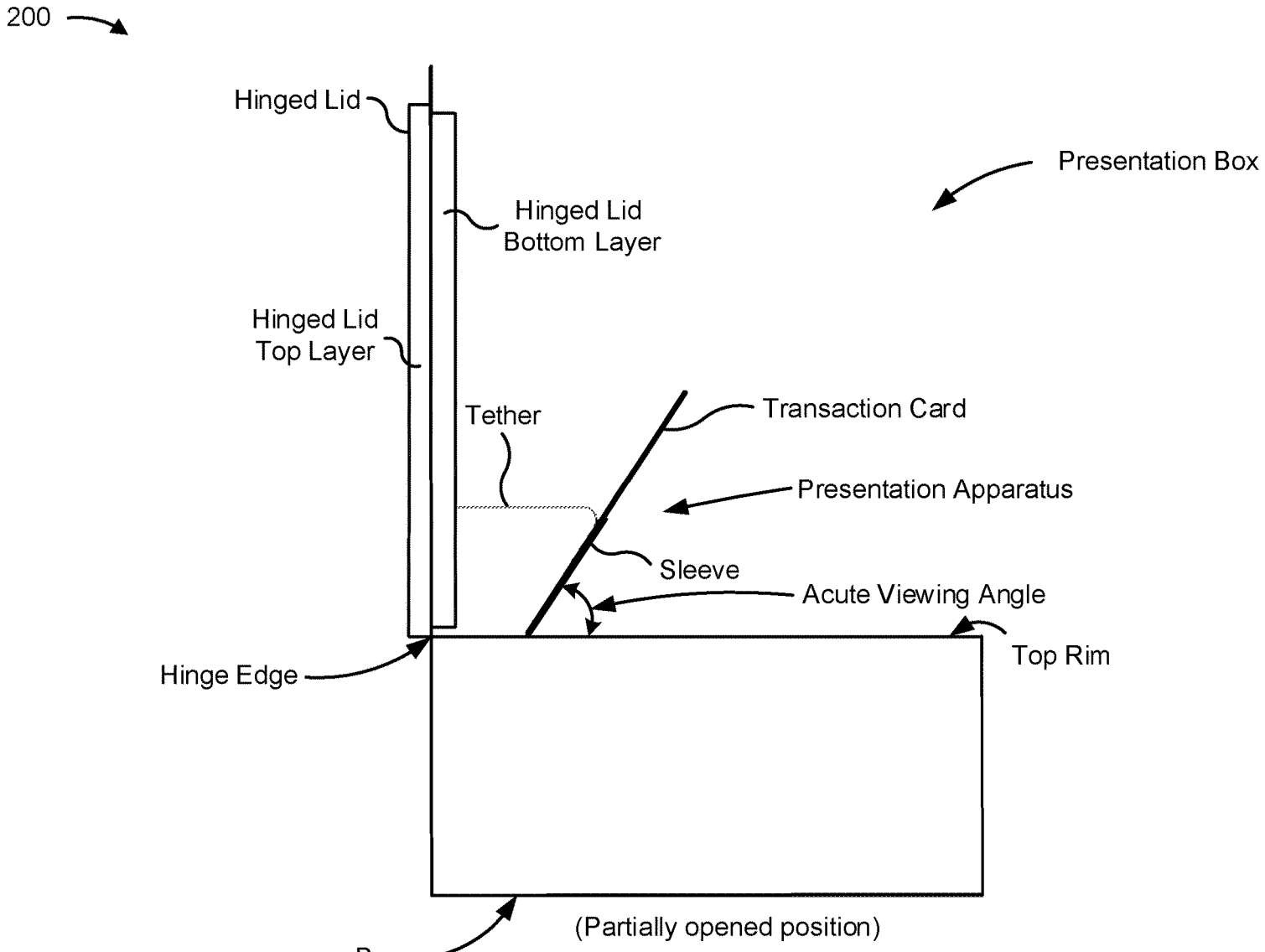
Figure 2C:
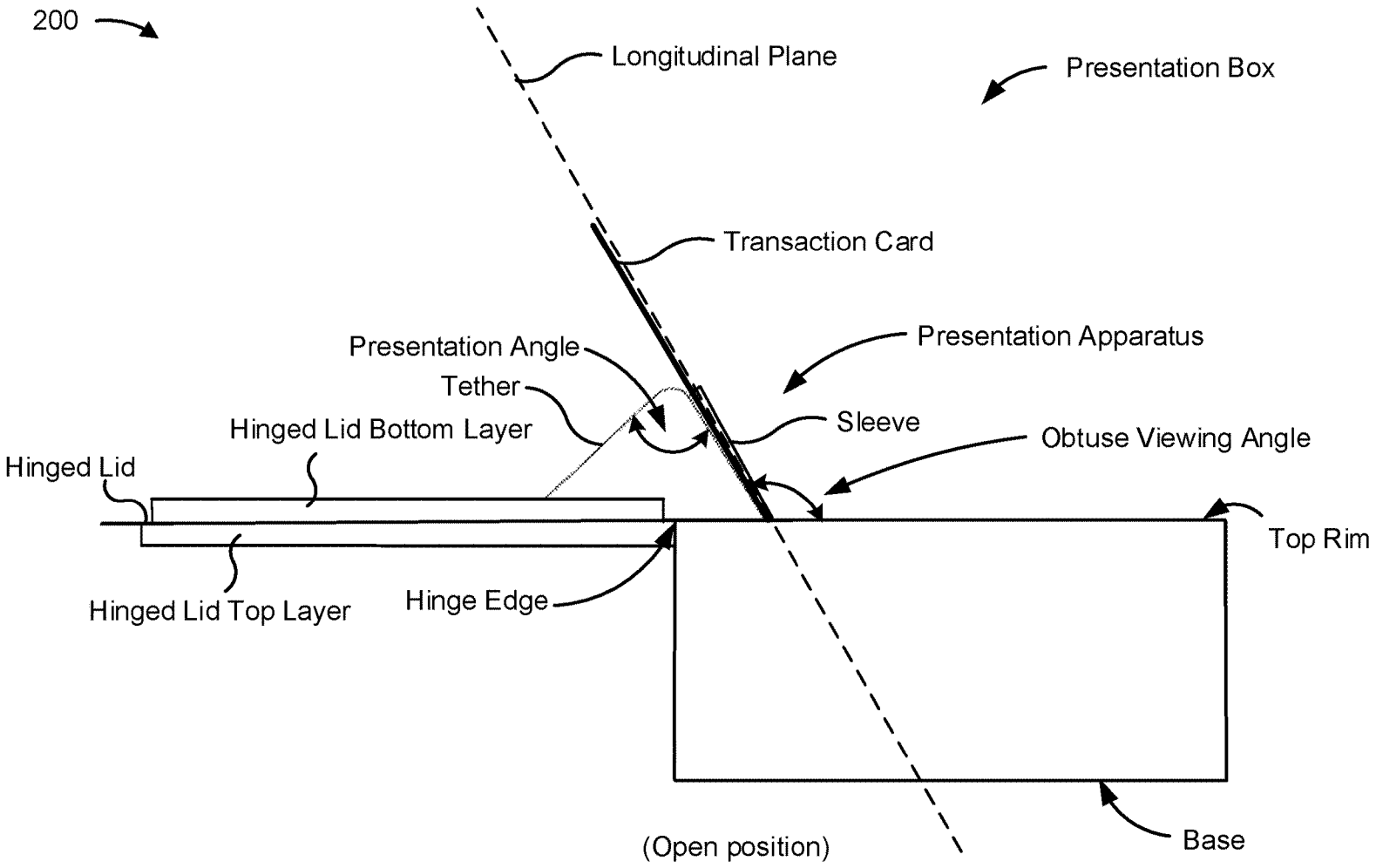

FIGS. 2A-2C are diagrams of an example implementation 200 of a use of the presentation assembly of FIG. 1. In FIGS. 2A-2C, the presentation assembly shows a manner in which the presentation box presents the card as the presentation box (or the hinged lid of the presentation box) is moved between a closed position (FIG. 2A), a partially open position (FIG. 2B), and an open position (FIG. 2C). As shown in FIG. 2A, the hinged lid of the presentation box is closed. Accordingly, the presentation apparatus and/or the presentation card are enclosed within the presentation box.

In FIG. 2B, the presentation box is shown in a partially open position. In the partially open position, the presentation apparatus, along with the card in the sleeve of the presentation apparatus, is exposed, presenting the transaction card at an acute viewing angle relative to the top rim (and/or base) of the presentation box. Accordingly, a user opening the presentation box may begin to see the transaction card as the hinged lid reaches the partially open position. As shown in FIG. 2B, in the partially open position, the hinged lid is perpendicular to the top rim of the presentation box. In some implementations, in a partially open position, the hinged lid may not be perpendicular to the top rim of the presentation box.

In FIG. 2C, the presentation box is shown in an open position, further exposing the presentation apparatus and the transaction card and presenting the transaction card at an obtuse viewing angle relative to a top rim (and/or base) of the presentation box. Accordingly, the user opening the presentation box may see a face (e.g., a front side or identification side) of the transaction card appear as the viewing angle goes from acute toward obtuse and the transaction card is presented in a position that is substantially not parallel to the base of the presentation box. As shown, in the open position, the hinged lid is at a 180 degree angle with the top rim (and/or base) of the presentation box. In some implementations, in an open position, the hinged lid may not be at a 180 degree angle with the top rim (and/or base) of the presentation box.

Accordingly, the example implementation 200 of FIGS. 2A-2C enable a transaction card to be presented in a presentation box as a hinged lid of the presentation box is moved from a closed position to an open position by moving the transaction card from a first position to a second position via a presentation apparatus.

As indicated above, FIGS. 2A-2C are provided merely as an example. Other examples are possible and may differ from what was described with regard to FIGS. 2A-2C.

Figure 3A:
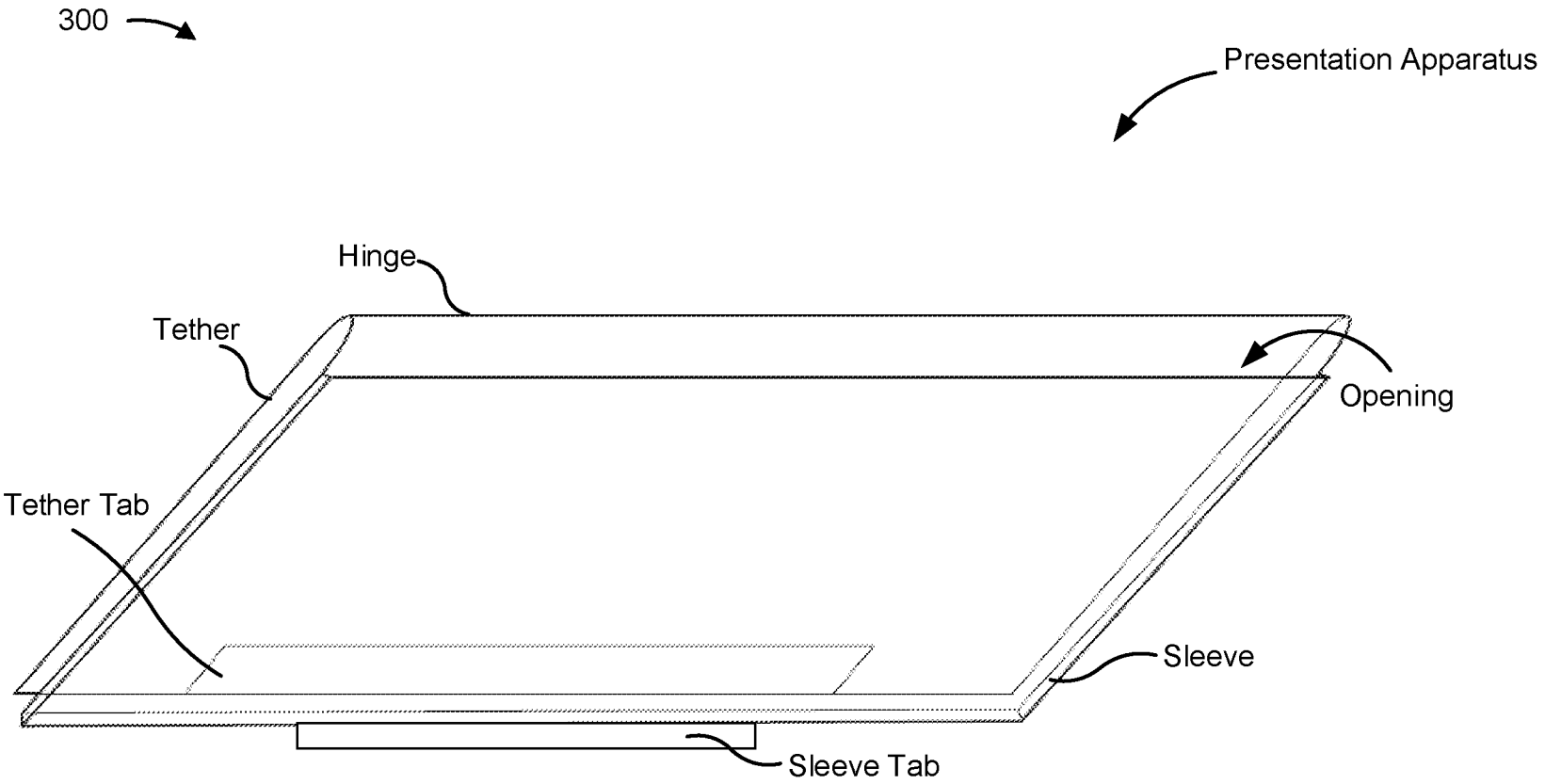
FIGS. 3A-3C are illustrations of an example implementation of a presentation apparatus for use with the presentation assembly of FIG. 1.
Figure 3B:
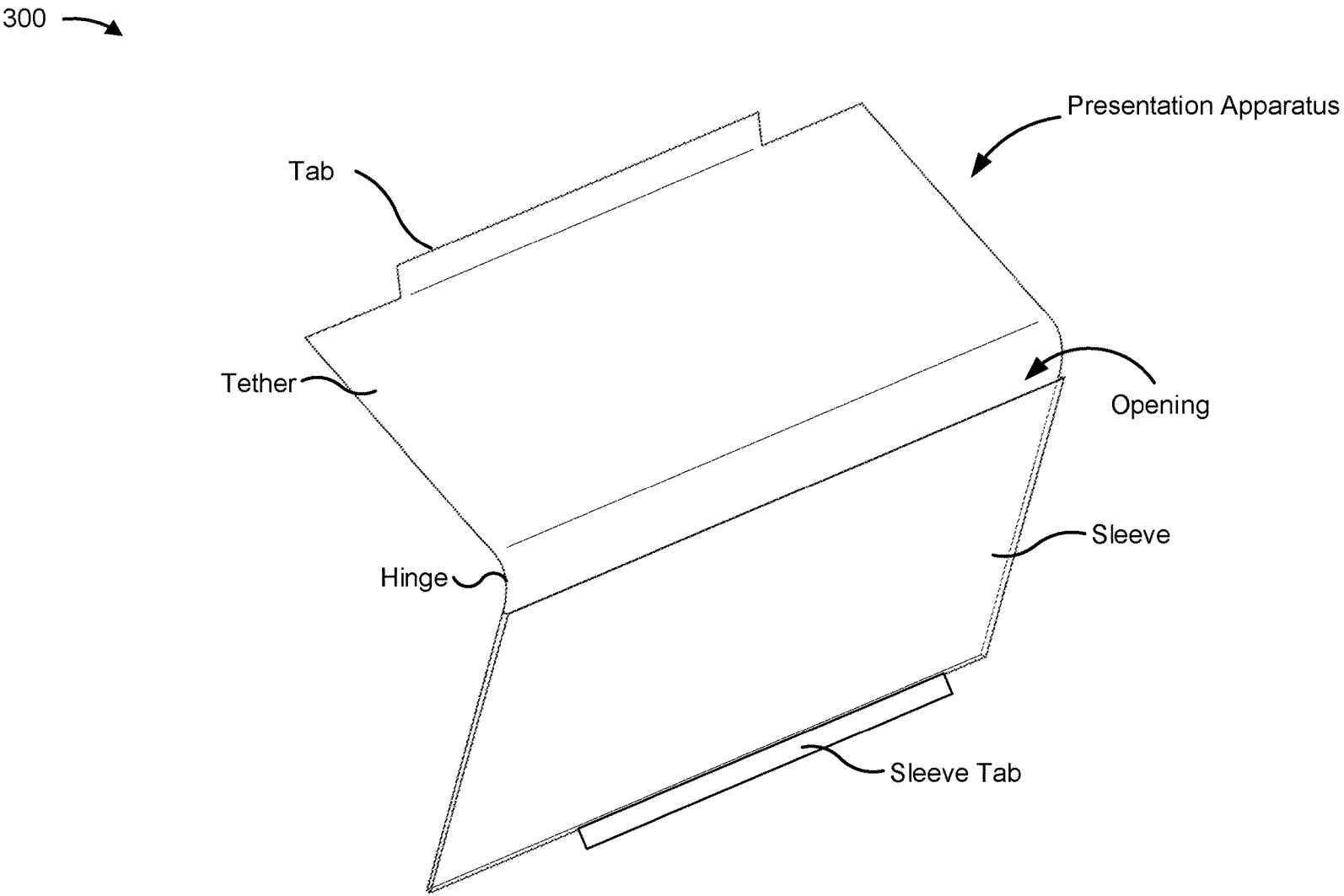
Figure 3C:
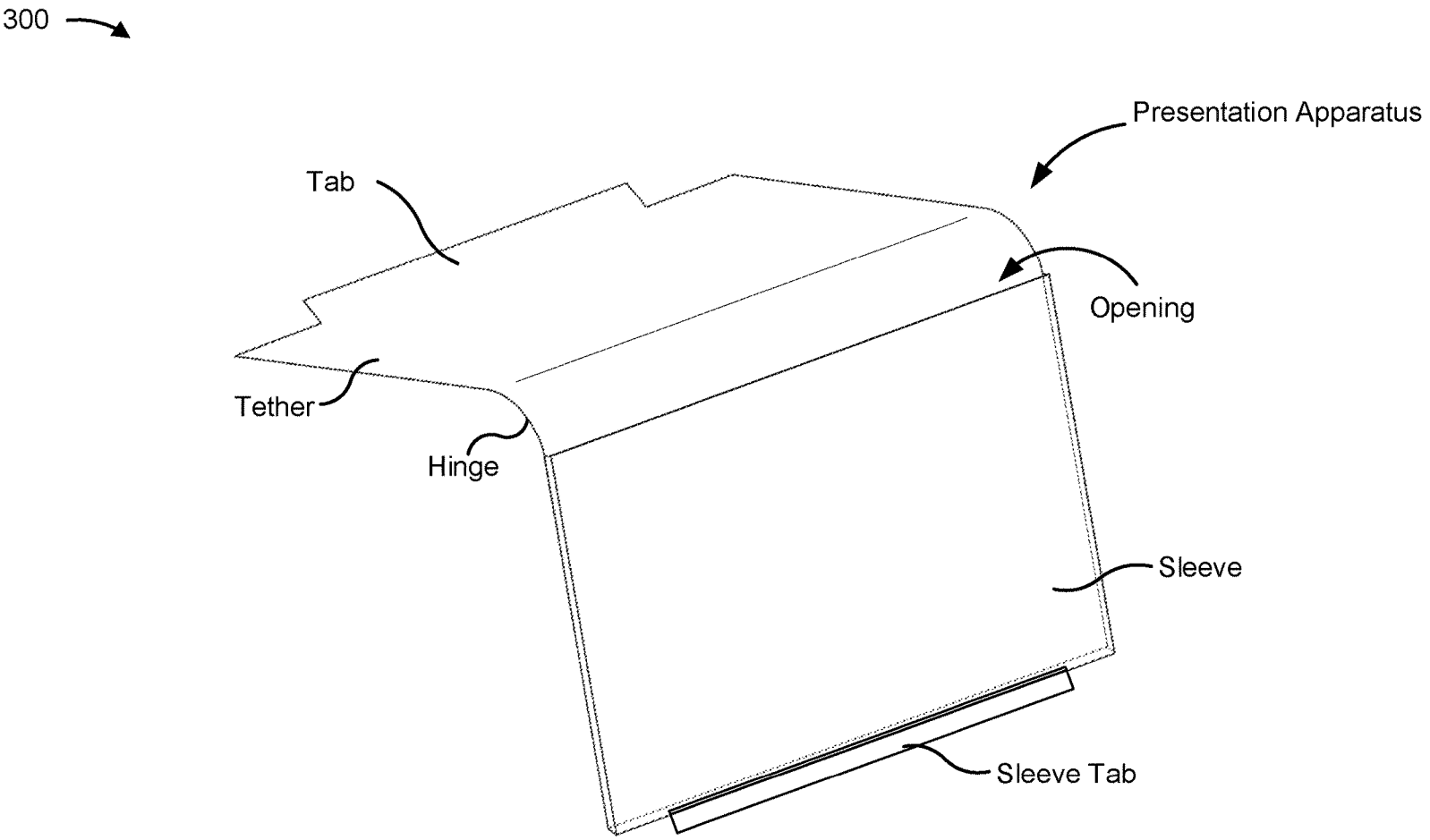

FIGS. 3A-3C are illustrations of an example implementation 300 of a presentation apparatus for use with a presentation assembly described herein. The presentation apparatus of example implementation 300 may correspond to the presentation apparatus of FIGS. 1 and 2A-2C. In FIGS. 3A-3C, the presentation apparatus is shown in a closed position (FIG. 3A), in a partially open position (FIG. 3B), and in an open position (FIG. 3C). As shown in FIGS. 3A-3C, the tether extends from an opening of the sleeve. The opening of the sleeve may receive the transaction card. For example, the opening of the sleeve may be substantially a same width as a width of the transaction card, such that the transaction card securely fits within the sleeve. As such, the transaction card may be secured within the sleeve to prevent the transaction card from sliding out or being removed from the sleeve when the presentation box is closed and/or due to a threshold force (e.g., gravity, a centripetal force, an impact from being dropped, and/or the like) being applied on the transaction card outwardly from a base of the sleeve.

Furthermore, in FIGS. 3A-3C, the presentation apparatus includes a tether tab. In some implementations, the tether tab may be attached to the hinged lid of the presentation box to secure the tether to the presentation box. For example, the tether tab may be adhered to the hinged lid of the presentation box and/or fit into the slot of the hinged lid. Furthermore, the presentation apparatus of example implementation 300 includes a sleeve tab. The example sleeve tab may be attached to a support of the presentation box to secure the sleeve to the presentation box. For example, the sleeve tab may be adhered to or fit into a structure of the support of the presentation box. Accordingly, the tabs of the presentation apparatus may be used to secure the presentation apparatus to the hinged lid and/or support of the presentation box.

In some implementations, the tether may be a same width as the sleeve. For example, the tether and the sleeve may be approximately 55 millimeters wide. In some implementations, the length of the tether and the depth of the sleeve may be approximately the same. For example the length of the tether and the depth of the sleeve may be approximately 35 millimeters. In some implementations, the dimensions of the tether and the sleeve may be different.

In some implementations, the depth of the sleeve may correspond to a size of the transaction card. For example, the depth of the sleeve may be less than half the length or the width of the transaction card, such that at least half (or fifty percent) of a front-side and a back-side of the transaction card is available for a user to grab. Accordingly, the presentation apparatus may facilitate and/or provide assisted removal of the transaction card from the presentation box.

In some implementations, the sleeve may include an object and/or device that assists with the removal of the transaction card from the sleeve. For example, the presentation apparatus may include a lifting tether or push up device within the sleeve, such that when the hinged lid is moved from a first position (e.g., a closed position) to a second position (e.g., and open position), the lifting tether or pop up device may at least partially extract the transaction card from the sleeve (e.g., by pulling or pushing the transaction card from the base of the sleeve). Accordingly, in some implementations, a majority of the transaction card may be within the sleeve when the presentation box is closed, and, after the presentation box is opened, less than the majority of the transaction card may be within the sleeve, facilitating assisted removal of the transaction card from the sleeve.

In some implementations, the presentation apparatus of the example implementation 300 of FIGS. 3A-3C may be formed from a single piece of material (e.g., a plastic material). For example, the sleeve may be formed from folding sections of the piece of material to create a sheath that is capable of receiving the transaction card. Furthermore, the tether may be formed from the piece of material by folding the material at the opening of the formed sleeve to create a hinge between the tether and the sleeve. In some implementations, the material of the presentation apparatus may be a different material than the presentation box.

In some implementations, the presentation apparatus may be partially and/or entirely transparent. For example, the tether may be transparent and/or the sleeve may be transparent such that a part of the transaction card that is within the sleeve may be visible when the hinged lid and/or presentation apparatus is in the partially open and/or open position.

In this way, a presentation apparatus may present a transaction card in a presentation box by holding the card as the presentation apparatus moves based on a hinged lid of the presentation box opening and/or closing, thus moving the card between a first position when the hinged lid is closed and a second position when the hinged lid is open (or at least partially open).

As indicated above, FIGS. 3A-3C are provided merely as an example. Other examples are possible and may differ from what was described with regard to FIGS. 3A-3C.

Figure 4A:
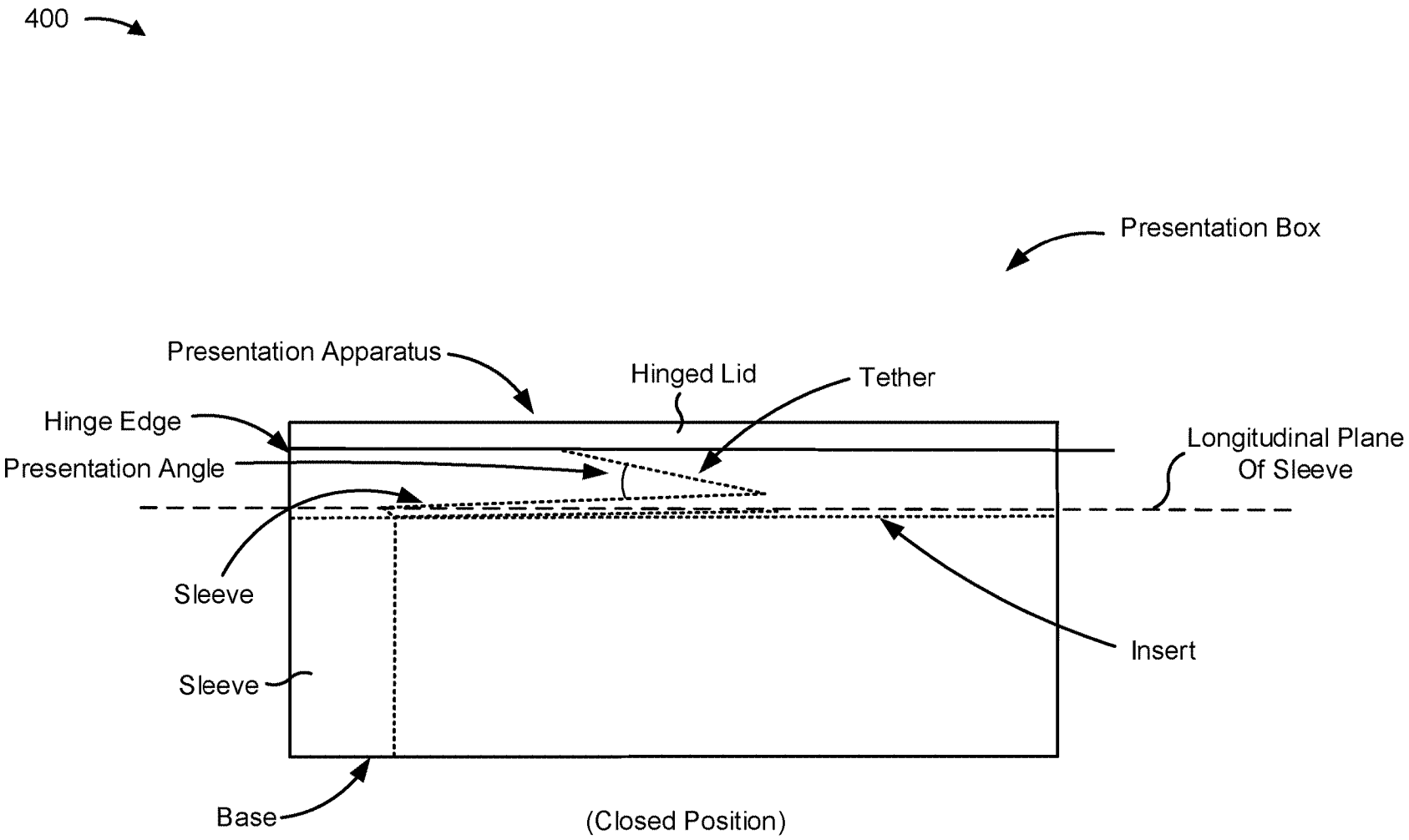
FIGS. 4A-4C are diagrams of another view of the example implementation of the presentation assembly of FIG. 1.
Figure 4B:
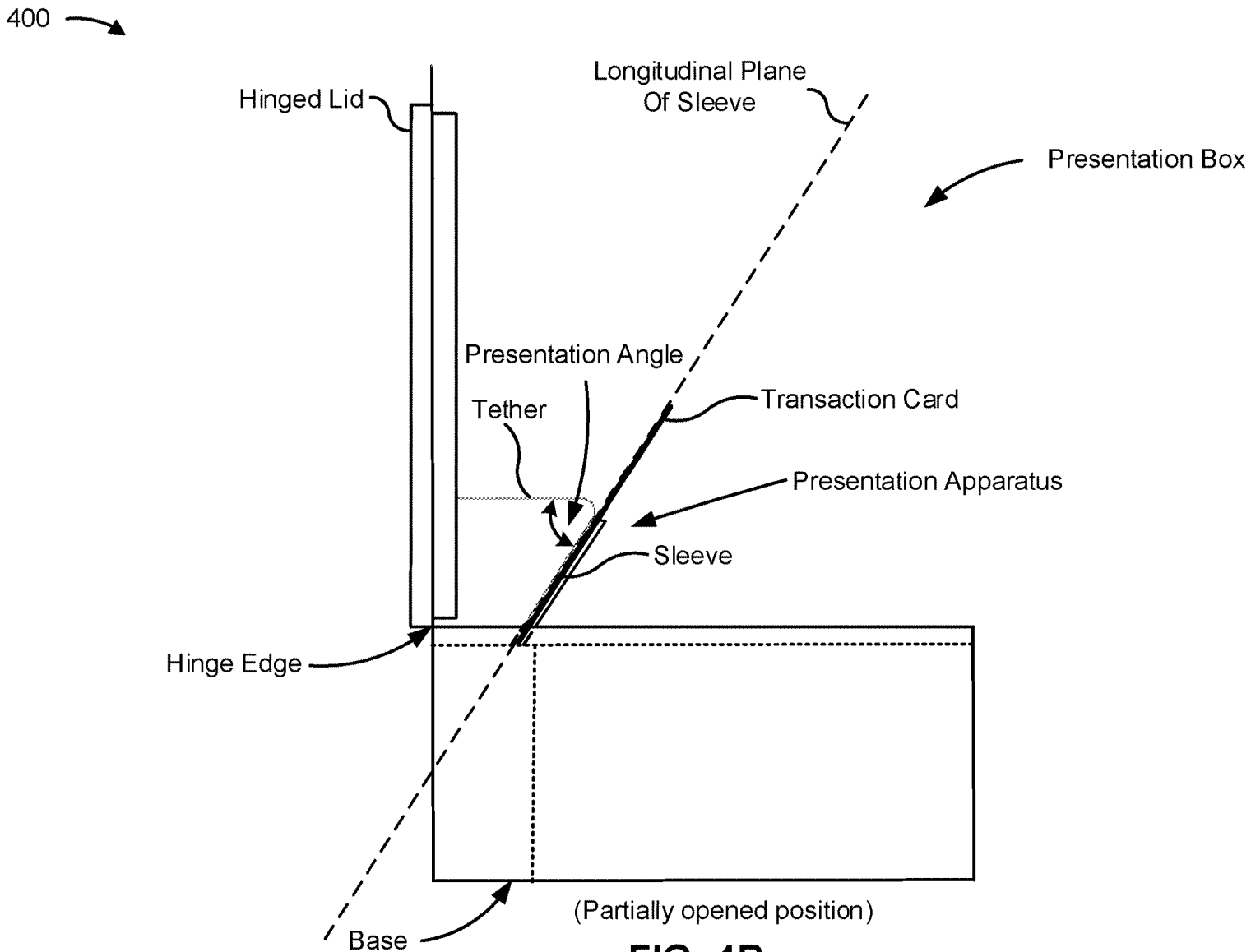
Figure 4C:
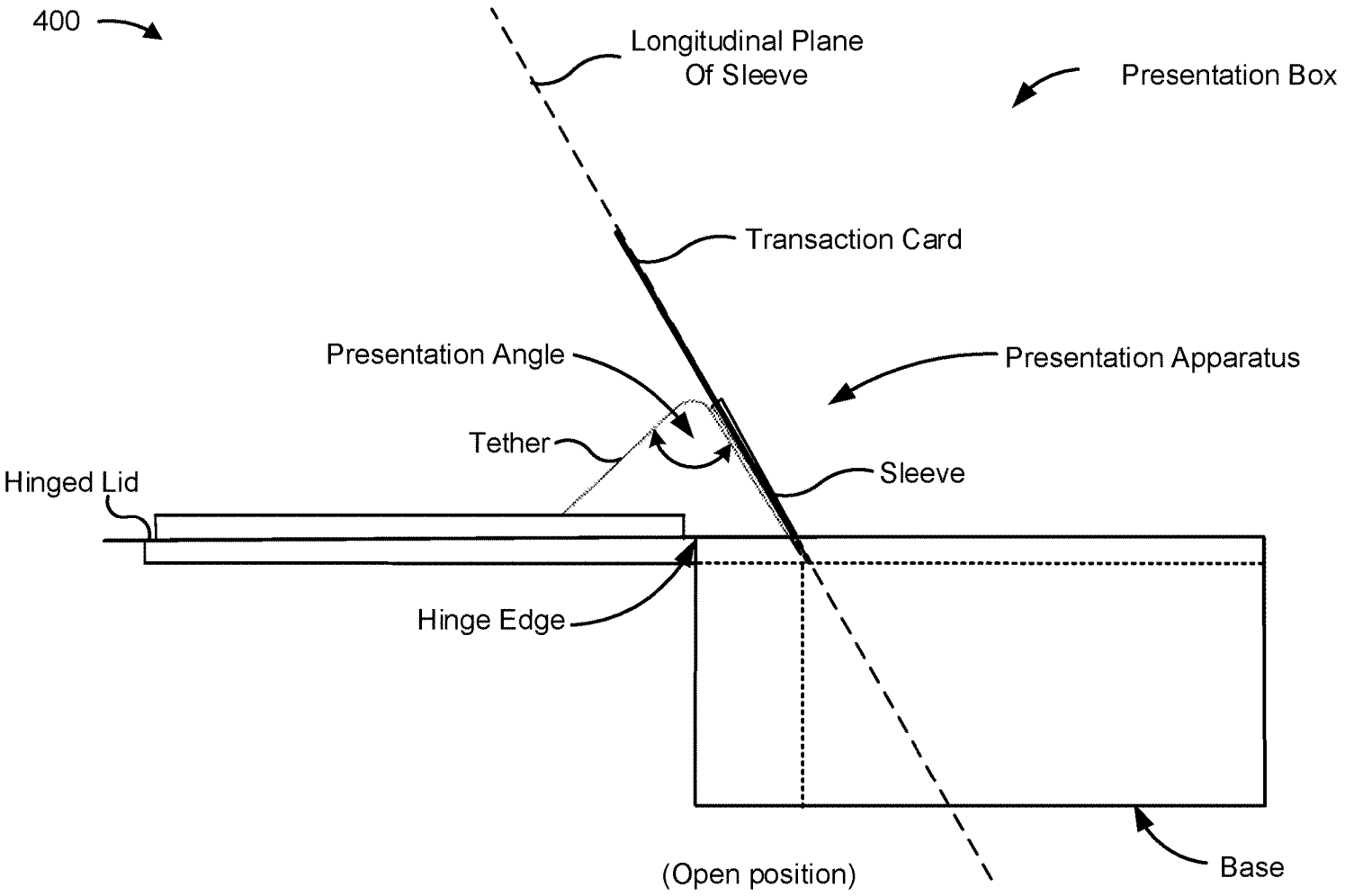

FIGS. 4A-4C are diagrams of another view of the example implementation 400 of the presentation assembly of FIG. 1. In FIGS. 4A-4C, the presentation assembly is illustrated to provide a view of the presentation apparatus within the presentation box as the hinged lid is moved between a closed position (FIG. 4A), a partially open position (FIG. 4B), and an open position (FIG. 4C).

As shown in FIG. 4A, the presentation box is in a closed position such that the hinged lid is in a position that encloses the presentation apparatus (shown with a dashed line) within the presentation box. In the closed position, a longitudinal plane of the sleeve, when the transaction card is in a first position (e.g., a closed position), is substantially parallel (e.g., within a threshold number of degrees of zero) to the base of the presentation box. In FIG. 4A, a presentation angle formed between the tether and the longitudinal plane of the sleeve is relatively small (e.g., less than approximately twenty degrees). As shown in FIGS. 4B and 4C, the longitudinal plane of the sleeve when the transaction card is in a second position (e.g., a partially open position or an open position), is not substantially parallel to the base of the presentation box. Accordingly, the orientation of the transaction card in the closed position may be different that the orientation of the card in the open position. Furthermore, as shown between FIGS. 4A-4C, the presentation angle between the tether and longitudinal plane of the sleeve increases as the hinged lid moves from the closed position (FIG. 4A) to the partially open position (FIG. 4B) (e.g., increases to between approximately twenty degrees and approximately sixty degrees), and further to the open position (e.g., increases to greater than approximately sixty degrees) (FIG. 4C).

As indicated above, FIGS. 4A-4C are provided merely as an example. Other examples are possible and may differ from what was described with regard to FIGS. 4A-4C.

Figure 5:
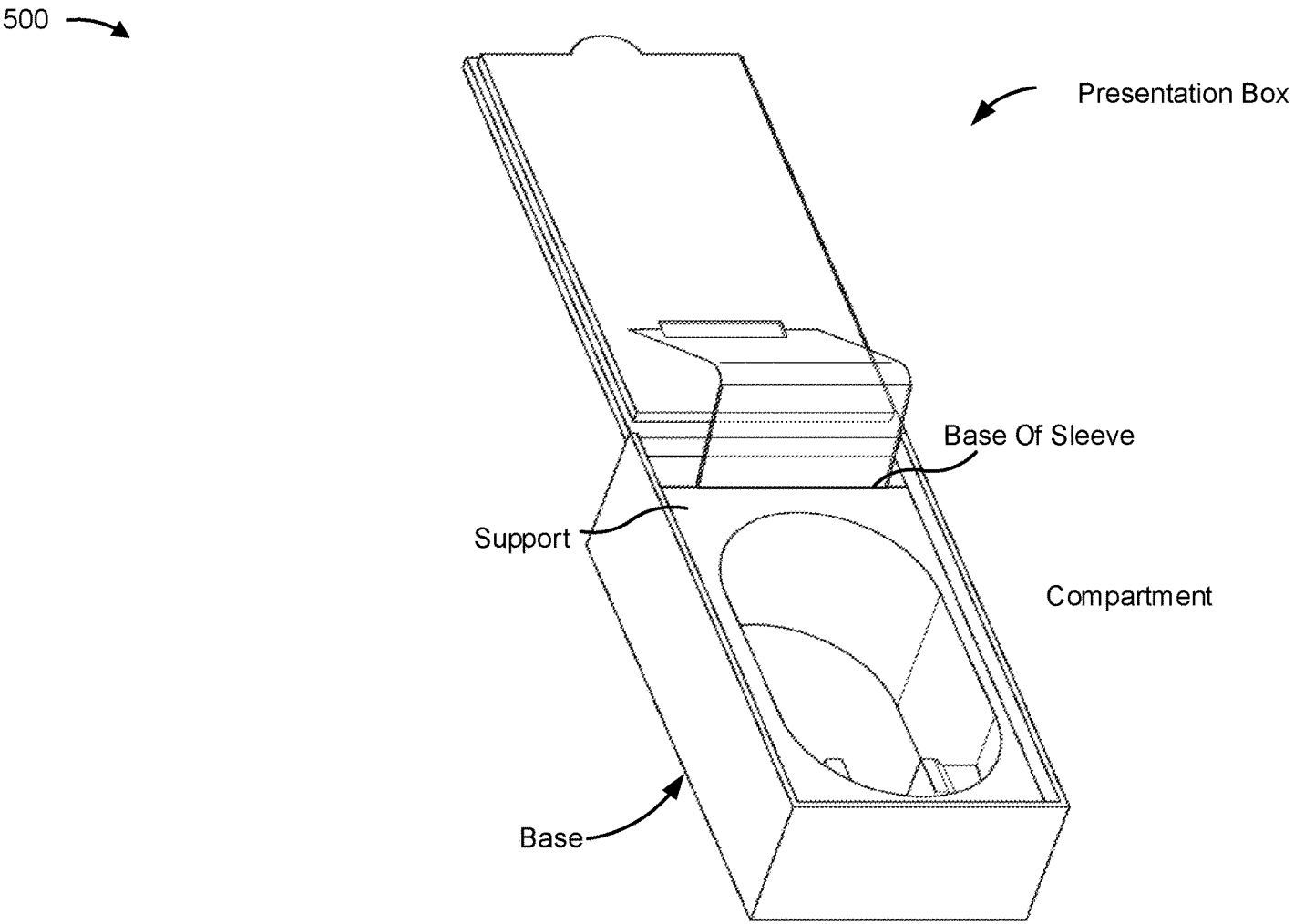
FIG. 5 is an illustration of another example implementation of a presentation assembly including a presentation box described herein.

FIG. 5 is an illustration of another example implementation 500 of a presentation assembly including a presentation box described herein. The presentation box of FIG. 5 may correspond to the presentation box of FIG. 1. As shown in FIG. 5, a compartment is provided in the presentation box. According to some implementations, the compartment may be accessed and/or revealed by removing an insert from the presentation box (e.g., the insert of FIG. 1). The compartment may include a volume of the presentation box that extends below the base of the sleeve toward the base of the presentation box. In some implementations, the compartment may store items associated with the transaction card. For example, the compartment of example implementation 500 may be shaped to hold or fit a charging apparatus to charge the transaction card, interfaces associated with the transaction card (e.g., a universal serial bus (USB) interface), communication interfaces associated with the transaction card (e.g., a Bluetooth interface), information materials (e.g., manuals, advertising, brochures, coupons, etc.) associated with the transaction card, and/or the like.

Accordingly, the presentation box may include a compartment to provide items associated with the transaction card as the transaction card is presented via the presentation apparatus according to some implementations herein.

As indicated above, FIG. 5 is provided merely as an example. Other examples are possible and may differ from what was described with regard to FIG. 5.

Figure 6:
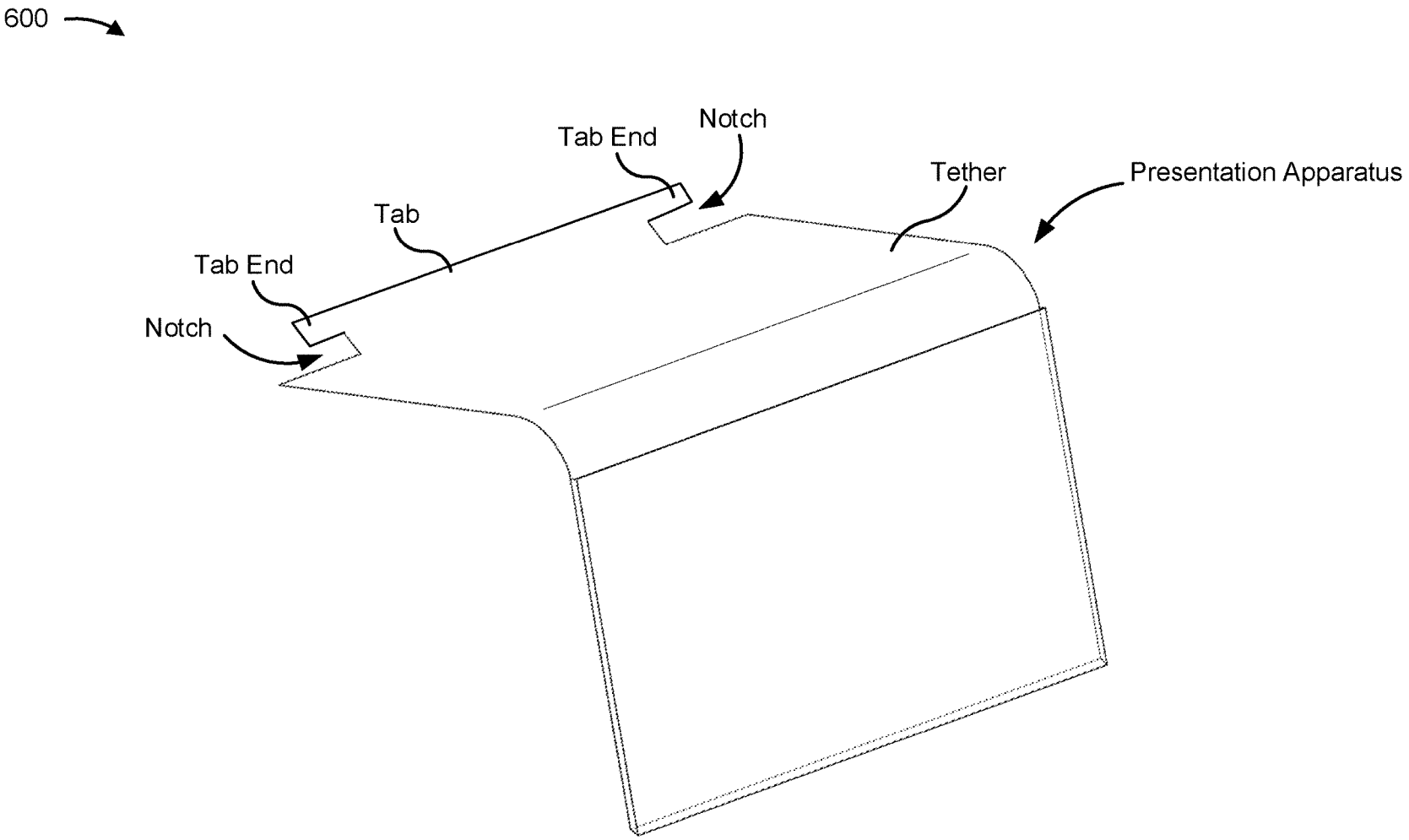
FIG. 6 is an illustration of another example implementation of a presentation apparatus for use with a presentation box described herein.

FIG. 6 is an illustration of another example implementation 600 of a presentation apparatus for use with a presentation box described herein. As shown in FIG. 6, the tether tab of the hinged lid includes notches positioned on opposite edges of the tether. For example, the tether tab may be formed from the first notch and the second notch. In some implementations, the distance between the notches may be approximately the same width of the slot of the hinged lid and the width of the tether tab may be greater than the length of the slot of the hinged lid. Accordingly, with the presentation apparatus formed from a flexible material (e.g., a plastic material), the tether tab may be fit into the hinged lid by inserting the tether tab into the slot, such that the ends of the tether tab are within a space of the hinged lid. In some implementations, a similar tab may be used to implement the sleeve tab and fit the sleeve tab into a structure or slot of the support of the presentation box.

In this way, the presentation apparatus may include one or more tabs with one or more notches that may be fit into a slot of the hinged lid to connect or attach the presentation apparatus to the hinged lid.

As indicated above, FIG. 6 is provided merely as an example. Other examples are possible and may differ from what was described with regard to FIG. 6.

According to some implementations herein a presentation assembly and/or a presentation box are provided to present a transaction card as the presentation box is opened by moving the transaction card from a first position when the presentation box is closed to a second position when the presentation box is opened (e.g., where the first position is different from the second position and/or where the first position has a different orientation from the second position). As such, a user may experience a unique presentation of the transaction card (e.g., when the transaction card is initially received or unboxed). Furthermore, the presentation assembly described herein may make a transaction card more available and/or accessible to a user by making more surface area available to the user when presenting the transaction card. For example, the transaction card may be presented such that at least fifty percent of a front, back, sides of the transaction card are available for a user to grab, thus facilitating removal of the card from the presentation box.

The foregoing disclosure provides illustration and description, but is not intended to be exhaustive or to limit the implementations to the precise form disclosed. Modifications and variations are possible in light of the above disclosure or may be acquired from practice of the implementations.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, or the like.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A presentation box comprising:

a hinged lid connected to a hinge edge of the presentation box, the hinged lid to pivot about the hinge edge of the presentation box; and a presentation apparatus comprising:

a tether that is attached to the hinged lid by a tab of the tether, where the tab of the tether is inserted into a slot in the hinged lid, a sleeve, where the tether is to move the sleeve when the hinged lid is pivoted about the hinge edge of the presentation box, and where the tab of the tether has a length that is greater than a length of the slot.

2. The presentation box of claim 1, where the presentation apparatus comprises:

a sleeve tab attached to a support of the presentation box.

3. The presentation box of claim 2, where the sleeve tab is adhered to or fit into the support of the presentation box.

4. The presentation box of claim 2, where the support comprises a structure that extends from a base of the presentation box toward the hinge edge of the presentation box.

5. The presentation box of claim 1, where the presentation apparatus is formed from a single piece of material.

6. The presentation box of claim 5, where the sleeve is formed from folding sections of the single piece of material to create a sheath.

7. The presentation box of claim 5, where the tether is formed from the single piece of material by folding the single piece of material at an opening of the sleeve to create a hinge between the tether and the sleeve.

8. The presentation box of claim 1, where the tab of the tether includes notches positioned on opposite edges of the tether.

9. The presentation box of claim 8, where a distance between the notches is a same width as the slot.

10. The presentation box of claim 1, where the tab of the tether is within a space of the hinged lid.

11. The presentation box of claim 1, further comprising:

a compartment that includes a volume of the presentation box that is below a base of the sleeve.

12. The presentation box of claim 1, where the presentation box is comprised of a plastic material.

13. The presentation box of claim 1, where the hinged lid is comprised of a different material than the presentation apparatus.

14. The presentation box of claim 1, where the hinged lid encloses the presentation apparatus when the hinged lid is in a closed position.

15. The presentation box of claim 1, where the slot is an opening of a bottom layer of the hinged lid, the hinged lid comprising a top layer and the bottom layer, where a space is formed in the hinged lid between the top layer and the bottom layer.

16. The presentation box of claim 1, where the hinged lid is configured to pivot about the hinge edge of the presentation box when moved between a closed position and an open position.

17. The presentation box of claim 1, where a longitudinal plane of the sleeve when the sleeve is in a first position is parallel to the hinged lid when the hinged lid is in a closed position.

18. The presentation box of claim 17, where the longitudinal plane of the sleeve when the sleeve is in a second position is not parallel to the hinged lid when the hinged lid is in an open position.

19. A presentation box comprising:

a hinged lid connected to a hinge edge of the presentation box, the hinged lid to pivot about the hinge edge of the presentation box; and a presentation apparatus comprising:

a tether that is attached to the hinged lid by a tab of the tether, where the tab of the tether is inserted into a slot in the hinged lid, a sleeve, where the tether is to move the sleeve when the hinged lid is pivoted about the hinge edge of the presentation box, and where the tether has a same width as the sleeve.

20. A presentation box comprising:

a hinged lid connected to a hinge edge of the presentation box, the hinged lid to pivot about the hinge edge of the presentation box; and a presentation apparatus comprising:

a tether that is attached to the hinged lid by a tab of the tether, where the tab of the tether is inserted into a slot in the hinged lid, a sleeve, where the tether is to move the sleeve when the hinged lid is pivoted about the hinge edge of the presentation box, where the tab of the tether includes notches positioned on opposite edges of the tether, and where a distance between the notches is a same width as the slot.

* * * * *